US006553688B1

(12) United States Patent
Lee

(10) Patent No.: US 6,553,688 B1
(45) Date of Patent: Apr. 29, 2003

(54) METHOD FOR PRODUCING A PIECE OF TIMBER INCLUDING HEARTWOOD

(76) Inventor: Shen-Ba Lee, No. 148-5, Wu-Fu Rd., Wu-Fu Village, Wu-Feng Hsiang, Taichung Hsien (TW)

( * ) Notice: Subject to any disclaimer, the term of this patent is extended or adjusted under 35 U.S.C. 154(b) by 0 days.

(21) Appl. No.: 10/044,046

(22) Filed: Jan. 11, 2002

(51) Int. Cl.[7] ..... F26B 5/14

(52) U.S. Cl. ..... 34/398; 34/382; 34/396; 144/361; 144/380

(58) Field of Search ..... 34/357, 382, 389, 34/396, 398, 415; 144/361, 380

(56) References Cited

U.S. PATENT DOCUMENTS 2,666,463 A * 1/1954 Heritage ..... 144/361
4,428,410 A * 1/1984 Strandberg ..... 144/361
5,190,088 A * 3/1993 Thomassen et al. ..... 144/361
5,564,199 A * 10/1996 Yamamoto et al. ..... 34/398
5,685,353 A * 11/1997 Viitaniemi et al. ..... 144/361
5,862,612 A * 1/1999 Bielfeldt ..... 34/398

* cited by examiner

*Primary Examiner*—Ira S. Lazarus
*Assistant Examiner*—Kathryn S. O'Malley
(74) *Attorney, Agent, or Firm*—Wolf, Greenfield & Sacks, P.C.

(57) ABSTRACT

A method for making wood with heartwood has steps of forming a wood log with a heartwood from a tree, pressure treatment to the wood log with the heartwood, drying the wood log and forming the wood log to a desired shape. The pressure treatment process is to apply a desired pressure to the wood log to reduce a moisture content of the wood log with the heartwood to an even level. This can avoid the wood log with the heartwood to split, crack or deform during the drying process. The utilization of a tree can be increased, and the process for gain a wood material is simplified.

8 Claims, 5 Drawing Sheets

METHOD FOR PRODUCING A PIECE OF TIMBER INCLUDING HEARTWOOD

BACKGROUND OF THE INVENTION

1. Field of the Invention

The present invention relates to a method for processing wood, and more particularly to a method for processing a piece of timber including heartwood from a tree whereby usable timber is gained.

2. Description of Related Art

Wood has for millenia been a very important material for furniture or buildings due to its availability and workability. To access the raw materials, once a tree is felled it is de-barked and the branches of the tree are trimmed away. The trunk is firstly cut into several logs or pieces with desired shapes, and the logs or the pieces are dried to reduce the moisture content to keep the wood from rotting, warping and so on. However, because the heartwood with the pith functions as an artery to supply water and nutrients to the branches and leaves from the root, the heartwood contains much more water than the other segment of the trunk. If a trunk containing heartwood is stored it easily cracks, splits and warps due to the uneven of the moisture content in the trunk during the drying process. Therefore, the conventional timber product does not contain the heartwood. A method for providing timber which excludes the use of heartwood (40) is shown in FIG. 5 wherein one trunk is cut into several pieces of timber (30) with desired shape. Another method which excludes use of the heartwood is to cut the trunk into several planks and to combine the planks to a timber piece (30) as shown in FIG. 6.

However, both those conventional methods contain the disadvantages as follow:

1. The efficient utilization of a tree is very low. Because the conventional methods discard the heartwood (40) and the branches of the tree are also cut off previously, the effective use of timber from a tree is only 40 to 50% which leads to excessive deforestation to meet the needs of consumers. In this age of environmental awareness it is apparent that such wasteful destruction of forests is unacceptable.

2. Excessive waste. The inefficient use of the natural resource is aggravated by the resulting waste material because to get a finished log of a certain size a much larger log must be found which is then cut to the required dimensions. A further aspect is that small trees are not usable due to being unable to meet finished size requirements. 3. The conventional methods are very troublesome. The conventional method is to cut a trunk of a tree into several pieces of timber (30) or into multiple planks except for the heartwood (40). In particular, the method as shown in FIG. 6 to cut the trunk into multiple planks and to combine the planks into a timber piece (30) is costly due to the various processes involved.

4. The structural strength of the timber piece (30) is not very good. In particular, a timber (30) produced by the conventional method as shown in FIG. 6 comprises several planks combined with glue, wherein the structural strength of the timber (30) is inferior to that of an integral piece of timber. The useful life of the timber (30) is also shorter than that of the integral material. In addition, if the timber (30) is combined with the planks from different trees, the grain lines on the combined timber (30) are not continuous and thus the appearance of the timber (30) is not beautiful.

To overcome the shortcomings, the present invention tends to provide a method for making timber products from a tree to mitigate or obviate the aforementioned problems.

SUMMARY OF THE INVENTION

The main objective of the invention is to provide a method for making timber including heartwood of trees. The method has steps of producing a piece of timber with a heartwood from a tree, pressure treatment to the timber with the heartwood, drying the timber and forming the timber to a desired shape. The pressure treatment process is to apply a desired pressure to the heartwood timber to reduce a moisture content thereof to an even level. This can prevent the timber with the heartwood from splitting, cracking or warping during the drying process. Thus, the efficient utilization of a felled tree can be increased, and the process for gaining timber products is simplified.

Other objects, advantages and novel features of the invention will become more apparent from the following detailed description when taken in conjunction with the accompanying drawings.

DETAILED DESCRIPTION OF PREFERRED EMBODIMENT

Figure 1:
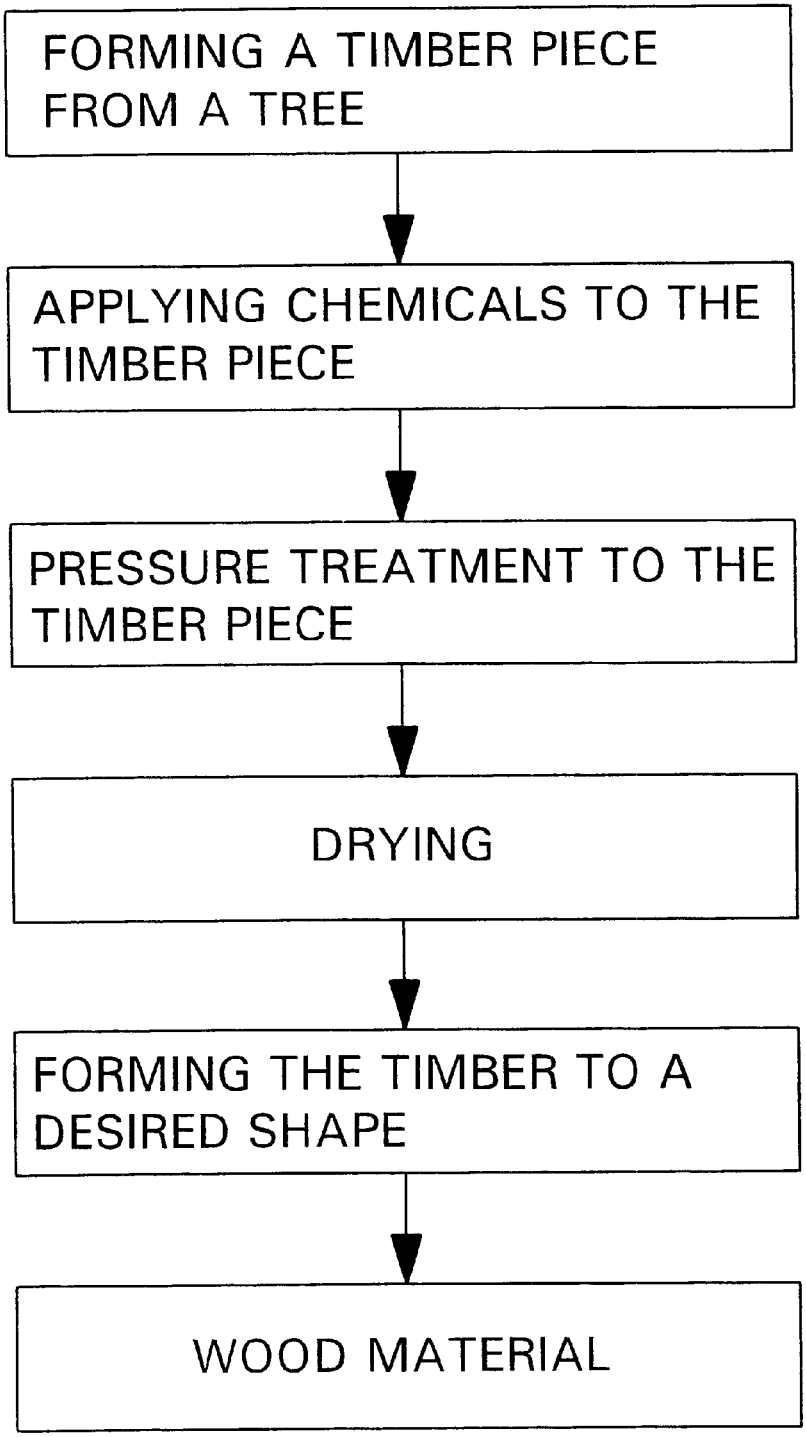
FIG. 1 is a flow chart of a method for making timber in accordance with the present invention.
Figure 2:
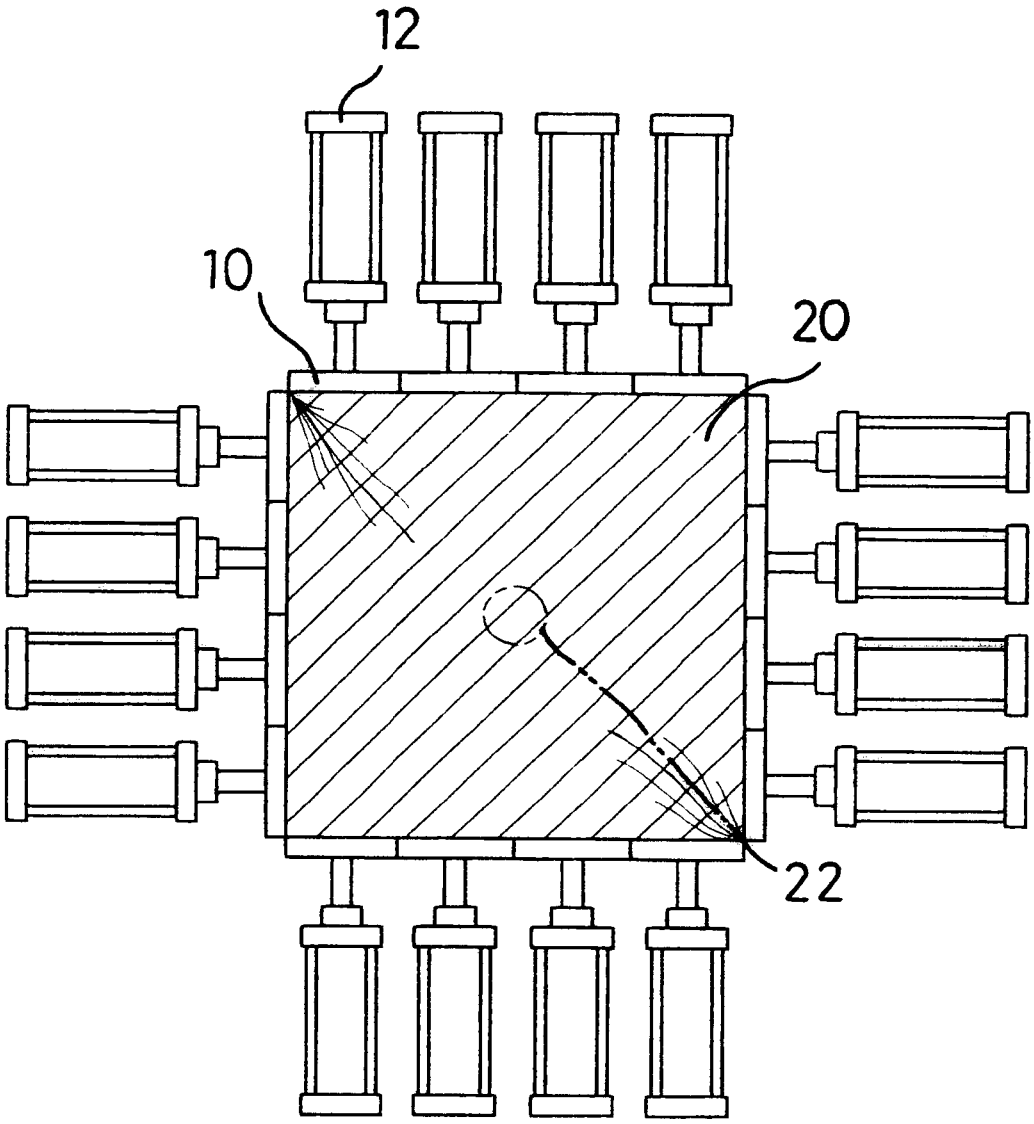
FIG. 2 is an operational plan view of a first embodiment of the pressure treatment process of the method in FIG. 1 to treat a timber piece with a rectangular cross section.
Figure 3:
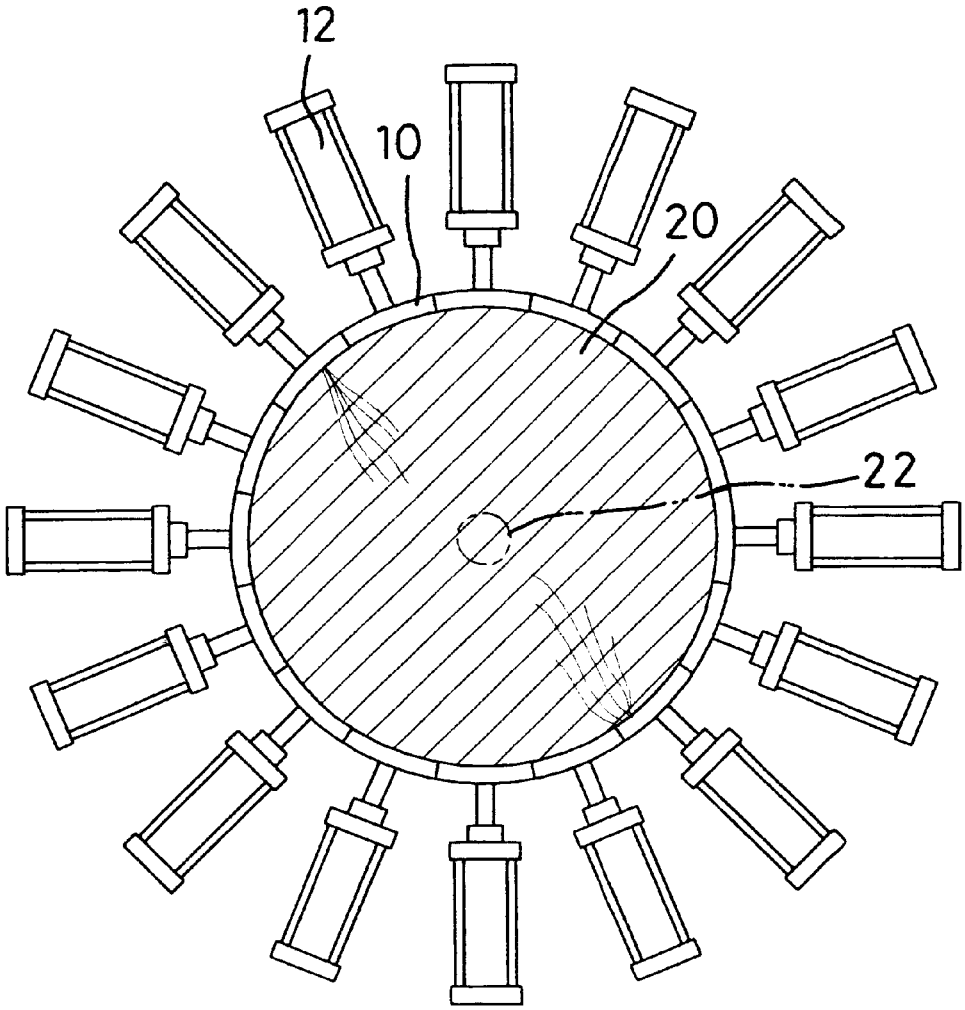
FIG. 3 is an operational plan view of a second embodiment of the pressure treatment process of the method in FIG. 1 to treat a timber piece with a circular cross section.
Figure 4:
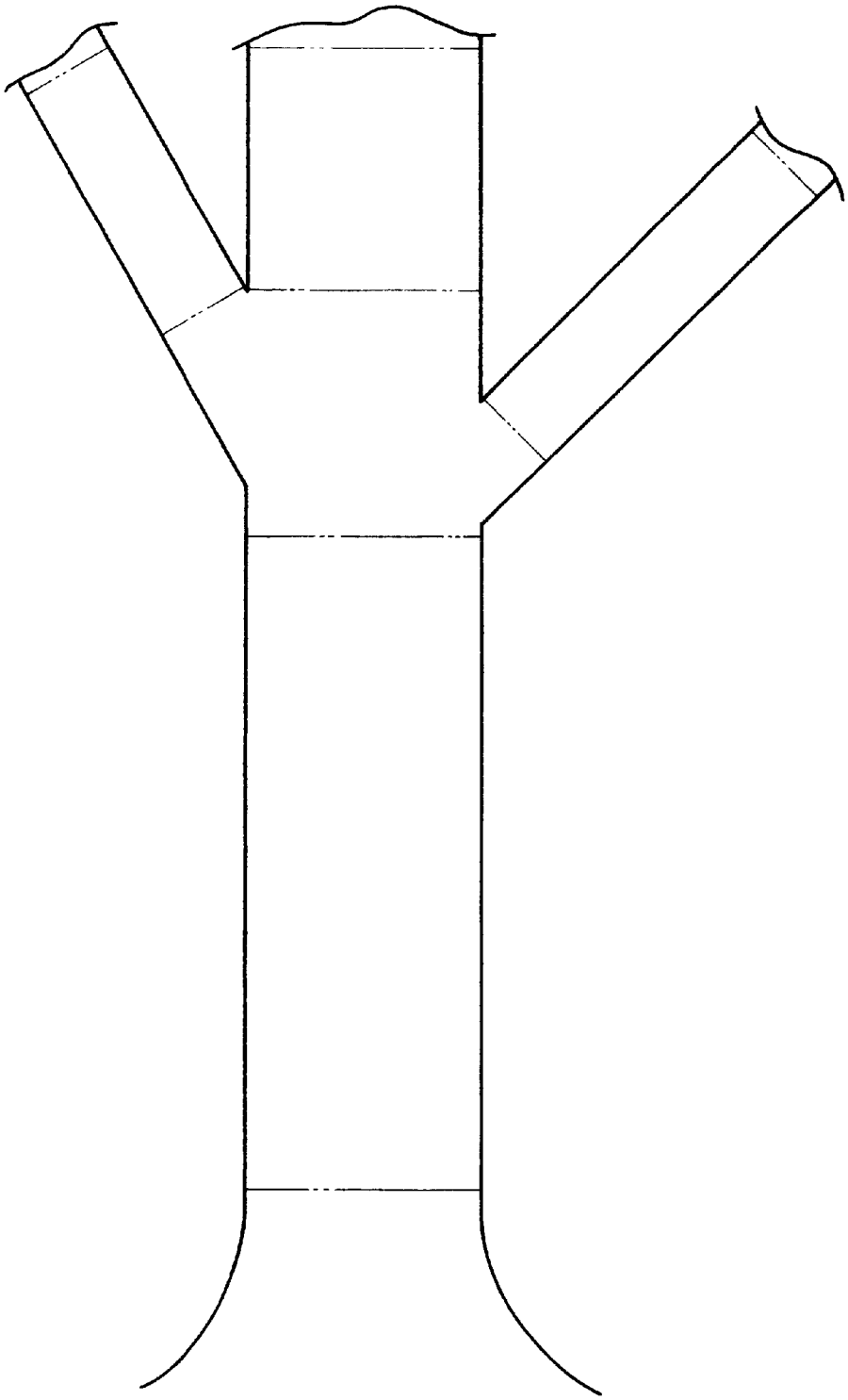
FIG. 4 is a schematic diagram of a tree that can make several pieces of timber using different parts of the tree by the method in FIG. 1.

With reference to FIGS. 1 to 3, a method for making timber including heartwood of a tree in accordance with the present invention comprises the steps of:

1. Forming a timber piece (20) with a heartwood (22) from a tree, wherein the tree is de-barked and is cut into at least one part. Each part of the tree is formed to a timber piece (20) with a particular cross section, like a rectangular cross section as shown in FIG. 2 or a circular cross section as shown in FIG. 3. The timber piece contains the heartwood (22). The part of the tree for providing the timber can be the trunk or a large limb of the tree.

2. Applying chemicals such as a preservative to the piece of timber (20), wherein if the timber (20) is cut from some special trees like rubber trees or the like, preservative must be applied to the timber (20) to keep it from rotting or becoming infested with insects. If the timber (20) is obtained from the other trees like such as common pine, the step of applying chemicals can be omitted.

3. Pressure treatment to the piece of timber (20), wherein appropriate pressure is applied to the timber (20) to reduce the moisture content of the whole piece of timber (20) with the heartwood (22) to a desired level. With reference to FIGS. 2 and 3, multiple pressing plates (10) are arranged around the timber (20) and abut the outer periphery of the timber (20) to provide an even force to every part of the timber (20). A pressure source (12) provide a desired pressure is applied to each pressing plate (10) to compress the timber (20). The pressure source (12) can be a hydraulic cylinder and preferably, the timber (20) is pressed at about 200° C. and the pressure lasts 30 seconds. Consequently, the water in the timber (20), especially in the heartwood (22), will be pressed out. Thus, the moisture content of the heartwood (22) will reduce to a low level substantially equal to that of the other portion of the timber (20) and so the moisture content of the whole piece of timber (20) will be reduced to an even level.

4. Drying, wherein the timber (20) is dried to reduce the moisture content of the timber (20) to a very low level. Because the timber (20) with the heartwood (22) is reduced to an even level of moisture content by the pressure treatment process previously, the timber (20) with the heartwood (22) will not crack, split or warp during the drying process.

5. Forming the timber (20) to a desired shape, wherein the timber (20) is machined to a desired shape by conventional means. Consequently, the timber (20) including the heartwood (22) becomes a useful and reliable wood material for applying to furniture or buildings.

From the above description, it is noted that the invention has the following advantages.

Figure 5:
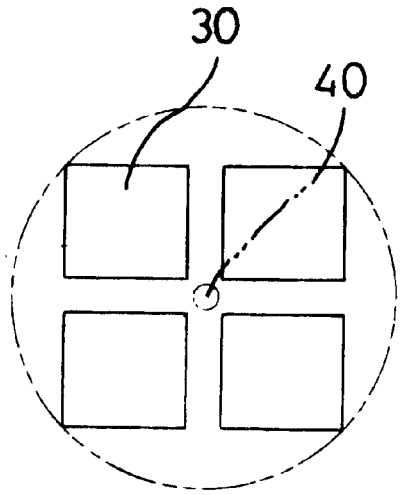
FIG.5 PRIOR ART
FIG. 5 is an operational plan view of a cross section of a tree from which several pieces of timber are cut by a conventional method in accordance the prior art.
Figure 6:
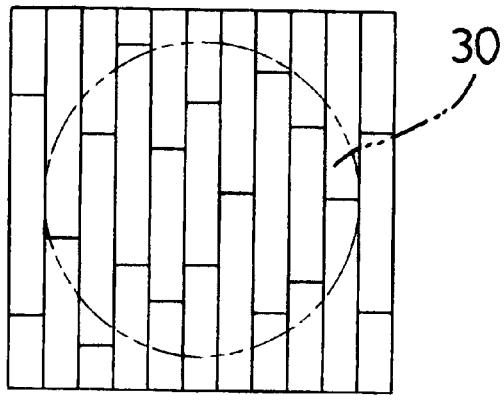
FIG.6 PRIOR ART
FIG. 6 is a plan view of a piece of timber made from combined multiple planks produced by another conventional method in accordance with the prior art.

1. Because the heartwood (22) is not discarded, the effective consumption of the tree can be increased which in turn reduces the quantity of trees needing to be felled. Furthermore, a small tree generally though to be insufficient to provide integral timber of commercial use can now provide practical timber. 2. Because to cut a tree into several pieces of timber (30) or into multiple planks as shown in FIGS. 5 and 6 is not needed, the process for gaining timber is simplified and so the cost for providing timber is reduced.

3. Because the piece of timber (20) made by the method in accordance with this invention is an integral structure, the structural strength of the thereof is enhanced. In addition, the special grain lines of a tree can be kept whereby the appearance of furniture or a building made using the timber (20) can be improved.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A method for producing timber with heartwood comprising steps follow:

forming a piece of timber including a heartwood from a tree;

pressure treatment of the piece of timber including the heartwood, wherein a desired pressure is applied to the piece of timber to reduce a moisture content of the piece of timber including the heartwood to a level consistent throughout the piece of timber and the heartwood;

drying the piece of timber including the heartwood to reduce the moisture content of the piece of timber including the heartwood to a desired level; and forming the piece of timber including the heartwood to a desired shape, wherein to provide the desired pressure to the piece of timber including the heartwood, multiple pressing plates are arranged around the piece of timber including the heartwood and abut an outer periphery of the piece of timber including the heartwood; and a pressure source is application to each pressing plate to compress the piece of timber including the heartwood.

2. The method as claimed in claim 1 further comprising a preserving process to apply a preservative to the piece of timber including the heartwood before the pressure treatment process.

3. The method as claimed in claim 2, wherein the tree is a rubber tree.

4. The method as claimed in claim 1, wherein the pressure source is a hydraulic cylinder.

5. The method as claimed in claim 1, wherein the piece of timber including the heartwood is pressed at about 200° C. and the pressure has a duration of 30 seconds.

6. The method as claimed in claim 1, wherein the piece of timber including the heartwood is pressed at about 200° C. and the pressure has a duration of 30 seconds.

7. The method as claimed in claim 1, wherein the piece of timber including the heartwood is formed from a trunk of the tree.

8. The method as claimed in claim 1, wherein the piece of timber including the heartwood is formed from a limb of the tree.

* * * * *